US006162068A

United States Patent [19]

Wu

[11] Patent Number: 6,162,068

[45] Date of Patent: Dec. 19, 2000

[54] ELECTRICAL CONNECTOR ASSEMBLY

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/357,783

[22] Filed: Jul. 21, 1999

[30] Foreign Application Priority Data

Oct. 23, 1998 [TW] Taiwan ..... 87217618

[51] Int. Cl.[7] ..... H01R 12/00

[52] U.S. Cl. ..... 439/79; 439/701

[58] Field of Search ..... 439/79, 80, 701, 439/660, 344, 676, 682, 692, 695

[56] References Cited

U.S. PATENT DOCUMENTS 5,085,601 2/1992 Buchter et al. ..... 439/660
5,161,999 11/1992 Broschard, III et al. ..... 439/607
5,591,036 1/1997 Doi et al. ..... 439/79
5,906,518 5/1999 Sun ..... 439/660
5,971,809 10/1999 Ho ..... 439/660
5,975,917 11/1999 Wang et al. ..... 439/701
6,033,258 11/1999 Huang et al. ..... 439/541.5
6,039,611 3/2000 Yang ..... 439/701

*Primary Examiner*—T. C. Patel
*Attorney, Agent, or Firm*—Wei Te Chung

[57] ABSTRACT

An electrical plug or receptacle connector mainly comprises a dielectric housing, at least one contact module and a spacer. The contact module comprises a dielectric contact base insert molded around middle portions of a number of contacts and can be assembled to the housing as a unit. The housing comprises a receiving chamber for receiving the corresponding contact modules therein thereby facilitating integral assembly of the electrical plug and receptacle connectors providing dependable signal transmission qualities.

17 Claims, 7 Drawing Sheets

ELECTRICAL CONNECTOR ASSEMBLY

BACKGROUND OF THE INVENTION

The present invention relates to an electrical connector assembly, and particularly to an easily assembled high density electrical connector which has excellent signal transmission qualities.

As technology develops, high density electrical connectors are becoming more commonly used in computer systems. Referring to pertinent conventional inventions, as disclosed in Taiwan Patent Application No. 84104534, contacts of a conventional high density connector cannot be easily manufactured due to the high density and small dimensions thereof. In addition, additional tools are required to insert the contacts into a housing of the conventional connector. Furthermore, the quality of electrical connections of such a finished conventional high density connector is often unsatisfactory, thus, the contacts are easily disengaged from a mating connector or a circuit board. Moreover, positioning the contacts at proper locations becomes complicated due to the small dimensions and high density thereof whereby some of the contacts may be driven out when a mating connector is inserted, resulting in poor or interrupted signal transmission quality.

BRIEF SUMMARY OF THE INVENTION

A main object of the present invention is to provide a high density electrical connector having excellent signal transmission qualities.

Another object of the present invention is to provide a high density electrical connector having a modular set of contacts positioned in an insert molded contact base which can be easily assembled into a dielectric housing of the connector.

In accordance with one aspect of the present invention, contacts of an electrical connector are positioned in an insert molded contact base as a unit thereby forming a contact module which can be directly assembled with a dielectric housing.

In accordance with another aspect of the present invention, stop means is formed on a dielectric housing for ensuring the proper position of a contact base receiving contacts therein thereby appropriately positioning the contacts.

In accordance with another aspect of the present invention, a spacer is provided for supporting contacts received therein thereby preventing the contacts from becoming withdrawn when a mating electrical connector is inserted, and thus, promoting dependable transmission quality.

Other objects, advantages and novel features of the invention will become more apparent from the following detailed description when taken in conjunction with the accompanying drawings.

DETAILED DESCRIPTION OF THE INVENTION

Figure 1:
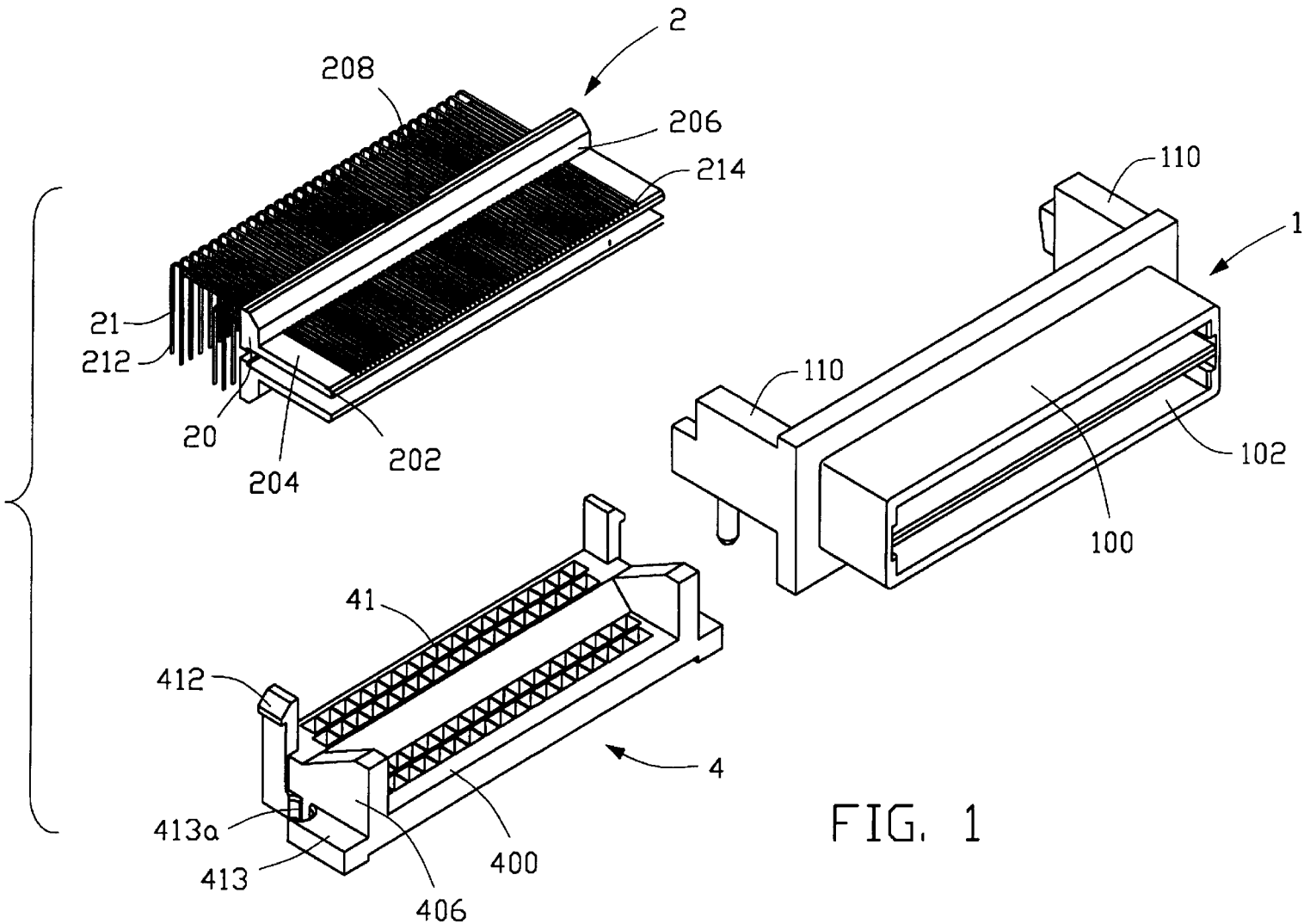
FIG. 1 is an exploded view of a plug-type connector assembly in accordance with the present invention.
Figure 2:
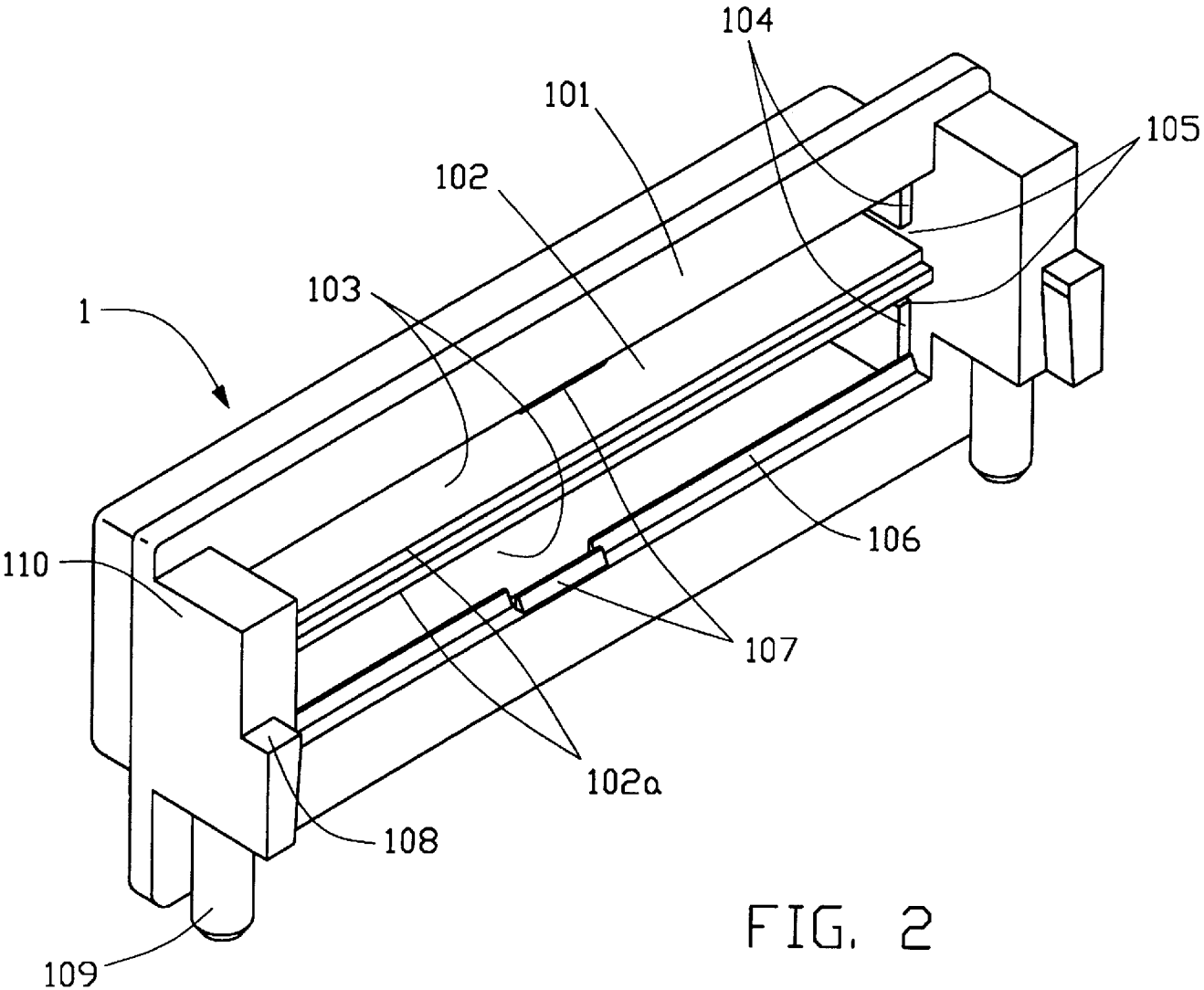
FIG. 2 is a perspective view of a dielectric housing of the plug-type connector assembly.

An electrical connector in accordance with the present invention can be a plug-type or a receptacle-type being mateable with each other. Referring to FIGS. 1 and 2, a plug-type connector assembly comprises a dielectric housing 1, a contact module 2 and a spacer 4. The dielectric housing 1 comprises a mating section 100 defining a receiving chamber 103 therein and a pair of joining sections 110. A flange 101 is formed between the mating section 100 and the joining sections 110. The joining sections 110 perpendicularly extend from opposite sides of the flange 101 and a pair of projecting side walls 108 rearwardly extend from the corresponding joining sections 110. A post 109 downwardly extends from each joining section 110 parallel to the flange 101. The receiving chamber 103 is divided into an upper channel and a lower channel by a spacing board 102. The spacing board 102 forwardly extends and aligns with a front end of the mating section 100 and forms a stopping step 102*a* at a rear end thereof proximate the joining section 110. Two pairs of stop boards 104 are formed at opposite ends of the upper and lower channels of the receiving chamber 103 and longitudinally extend along the joining section 110. A guiding groove 105 is defined between each stop board 104 and the spacing board 102. First and second bars 106 are inwardly and symmetrically formed at top and bottom surfaces of the upper and lower channels of the receiving chamber 103, respectively. Only the second bar 106 formed at the bottom surface of the lower channel is shown in FIG. 2. A stop barb 107 is formed proximate a middle portion of each bar 106.

The contact module 2 comprises a dielectric contact base 20 integrally insert molded around a plurality of contacts 21. Each contact 21 consists of a mating end 214 and a joining end 212. The contact base 20 is L-shaped and comprises a pair of horizontal plates 202 and a pair of vertical side walls 206. The mating ends of the contacts 21 are received in the corresponding horizontal plate 202 for electrically connecting with a mating receptacle, while the joining ends perpendicularly and downwardly extend from one side of the vertical side wall 206 opposite the horizontal plate 202. A guiding section 204 horizontally extends outwardly from opposite ends of each horizontal plate 202 and has a thickness equal to a width of the guiding grooves 105 of the housing 1 for proper insertion into the corresponding upper and lower channels of the receiving chamber 103 along the guiding grooves 105 thereby firmly positioning the contact module 2 in the dielectric housing 1. Each vertical side wall 206 outwardly extends beyond the horizontal plate 202 and defines a latching aperture 208 in a side surface of a top end opposite the horizontal plate 202 for engaging with the corresponding stop barb 107 of the housing 1. The vertical side walls 206 abut against the stop bar 106 and the stopping step 102*a* of the housing 1 thereby properly positioning the contact module 2. Thus, a mating connector is prevented from over-insertion into the housing 1 and the contacts 21 are prevented from being driven out by the mating receptacle being inserted into the housing 1.

The spacer 4 comprises upper and lower steps. Each step forms a horizontal plane 400 thereon. The horizontal plane

400 defines a plurality of receiving slots 41 corresponding to the contacts 21. A pair of stop side walls 406 are formed on opposite sides of the lower step thereby defining a space therebetween. A pair of projecting sections 413 extend from opposite bottom sides of the lower step each forming a semi-circular opening in an outer side thereof. A pair of latches 412 are formed on opposite sides of the upper step and defines a partial-circular opening in a lower portion for cooperating with the semi-circular opening thereby defining a opening 413*a* for receiving the corresponding post 109 therein.

Figure 3:
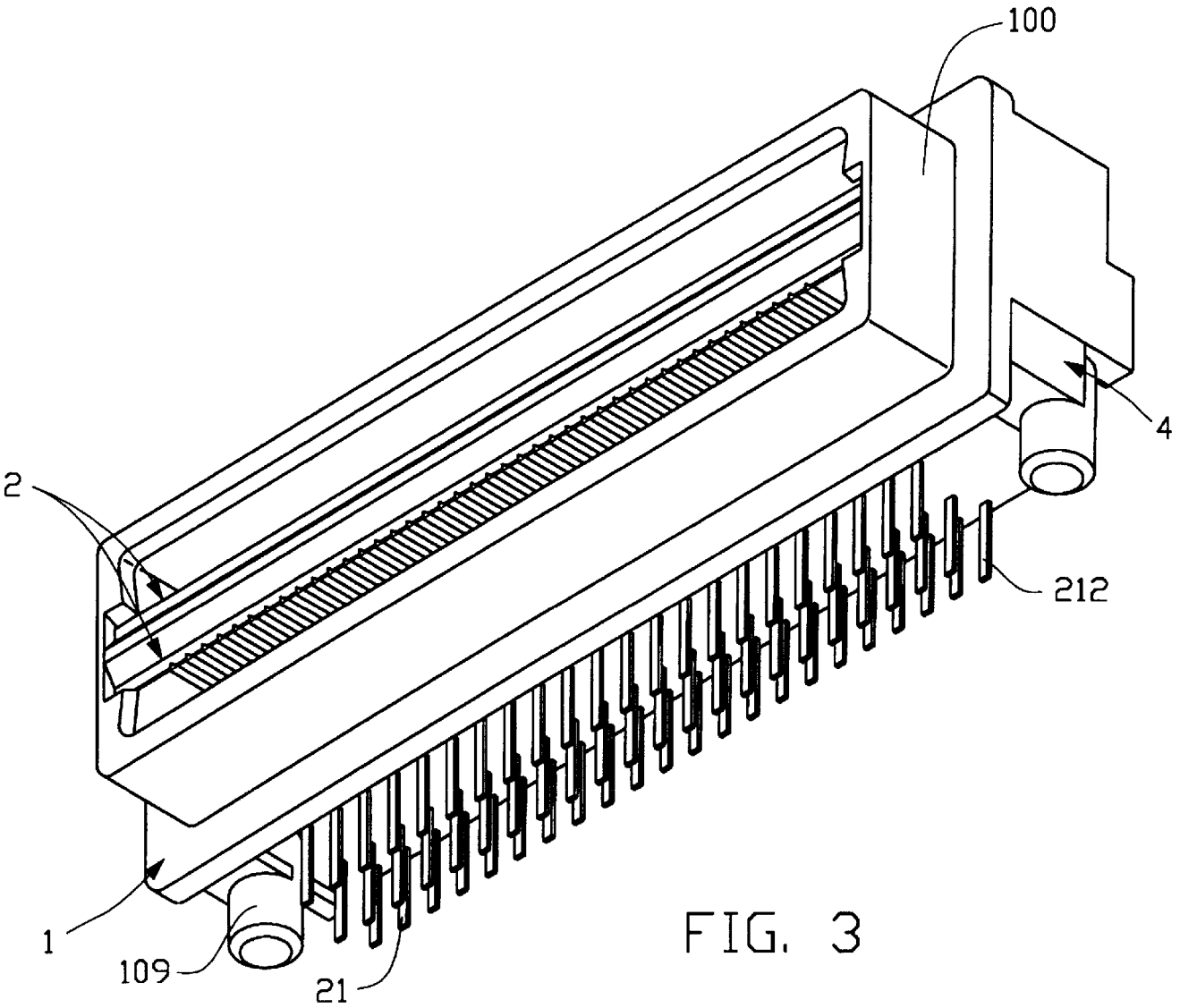
FIG. 3 is a front perspective assembled view of the plug-type connector assembly.
Figure 4:
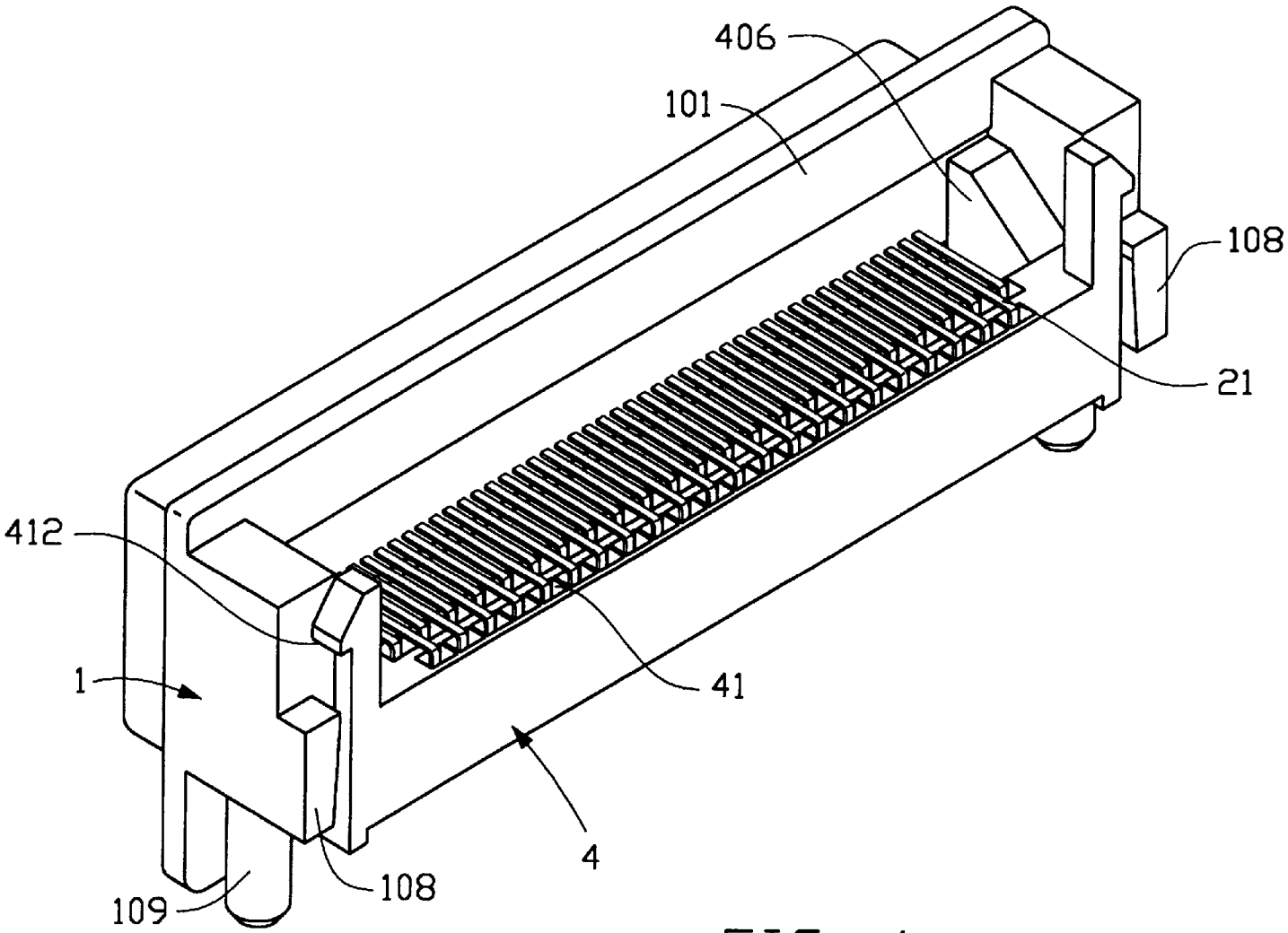
FIG. 4 is a rear perspective view of the plug-type connector assembly.

Referring to FIGS. 3 and 4, after the contact module is assembled, the joining sections of the contacts 21 are inserted into the corresponding receiving slots 41, and the posts 109 are inserted into the corresponding first openings 413*a*. The spacer 4 upwardly moves along the posts 109. The latches 412 abut against the projecting side walls 108 and the stop side walls 406 abut against the joining section 110 and a rear surface of the flange 101 opposite the mating section 100. Thus, the contacts 21 are securely positioned and prevented from becoming withdrawn when a mating receptacle is inserted into the mating section 100 of the housing 1.

Figure 5:
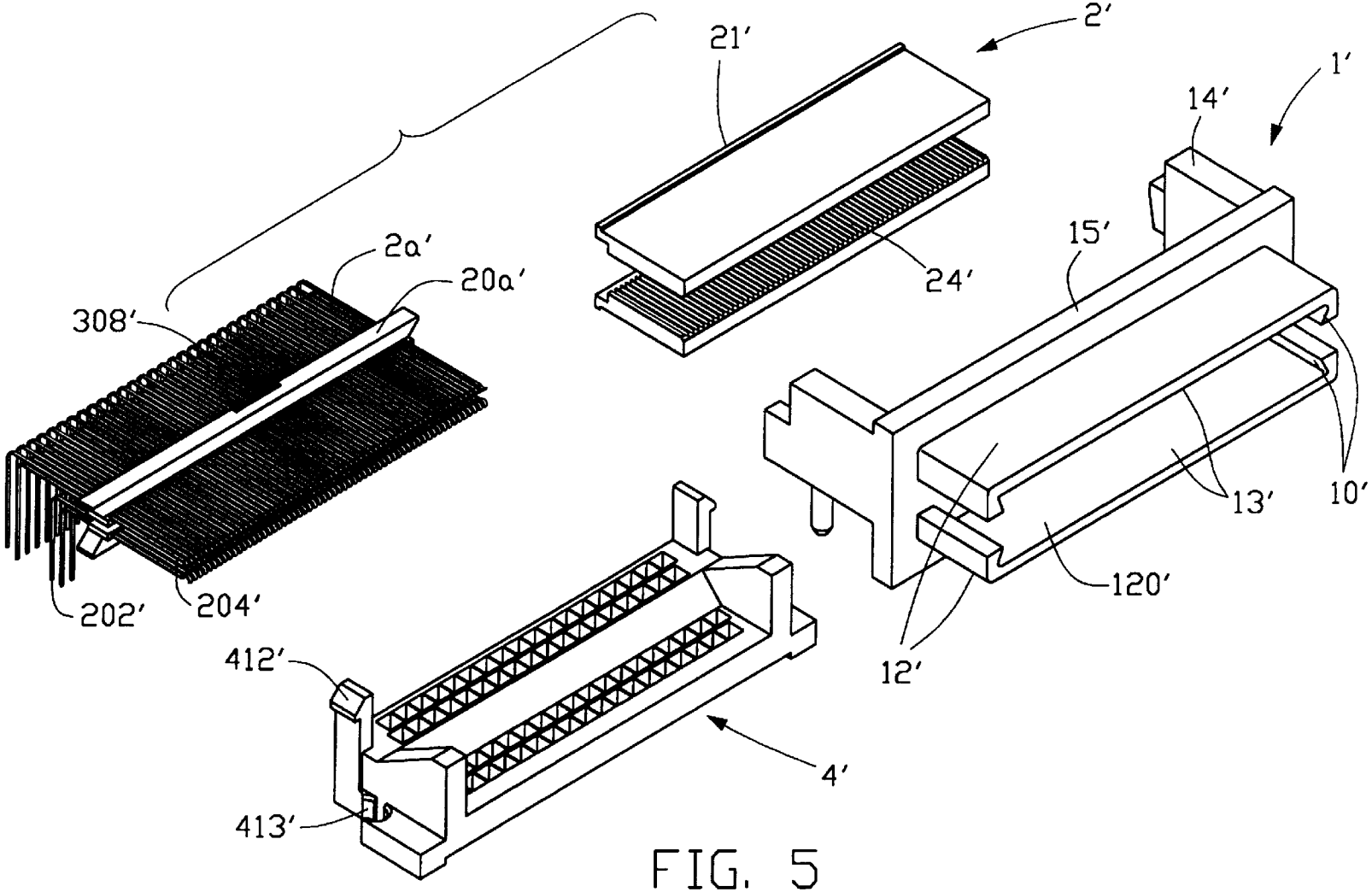
FIG. 5 is an exploded view of a receptacle-type connector assembly in accordance with the present invention.
Figure 6:
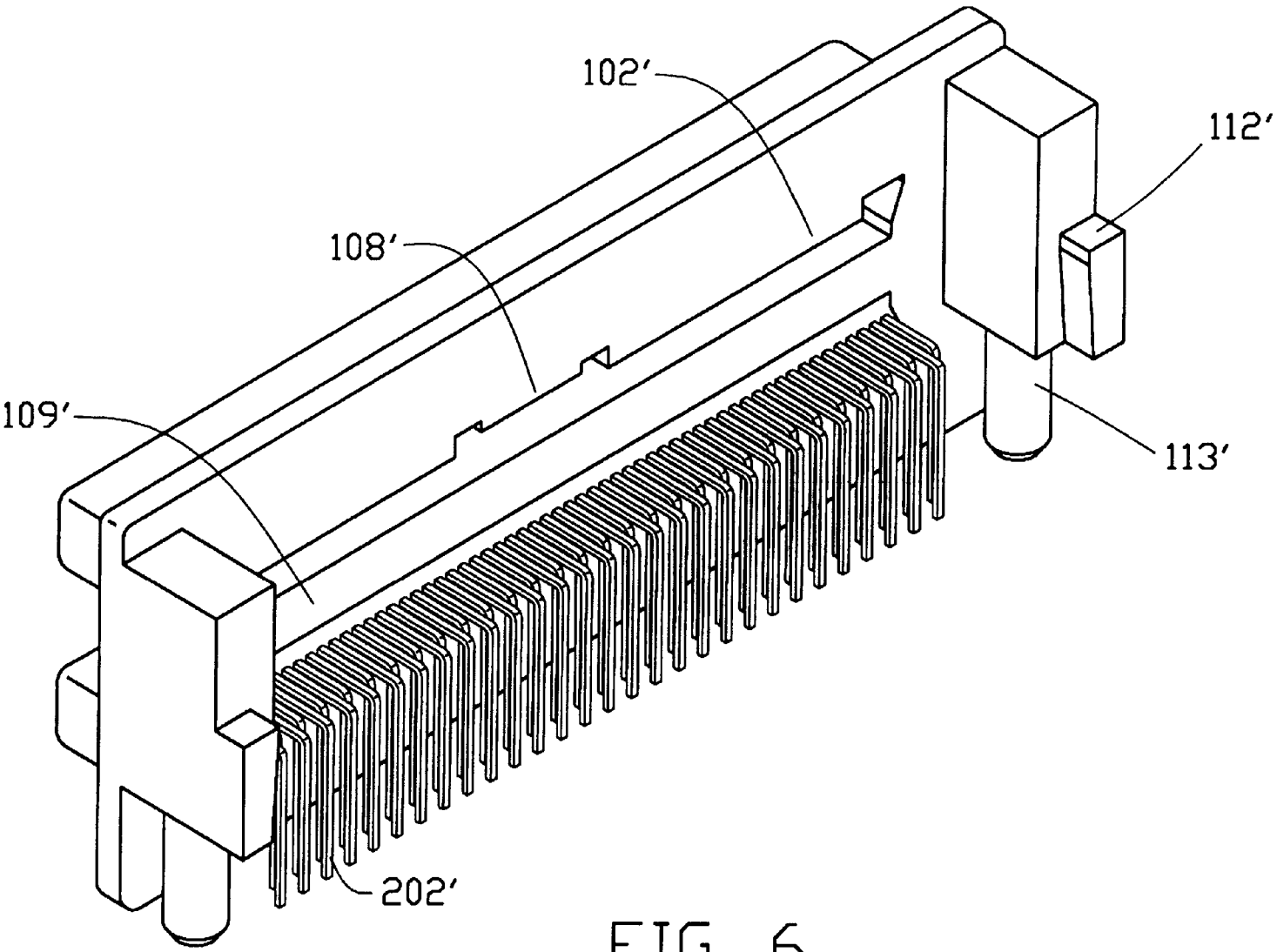
FIG. 6 is a partially assembled view of the receptacle-type connector assembly.
Figure 7:
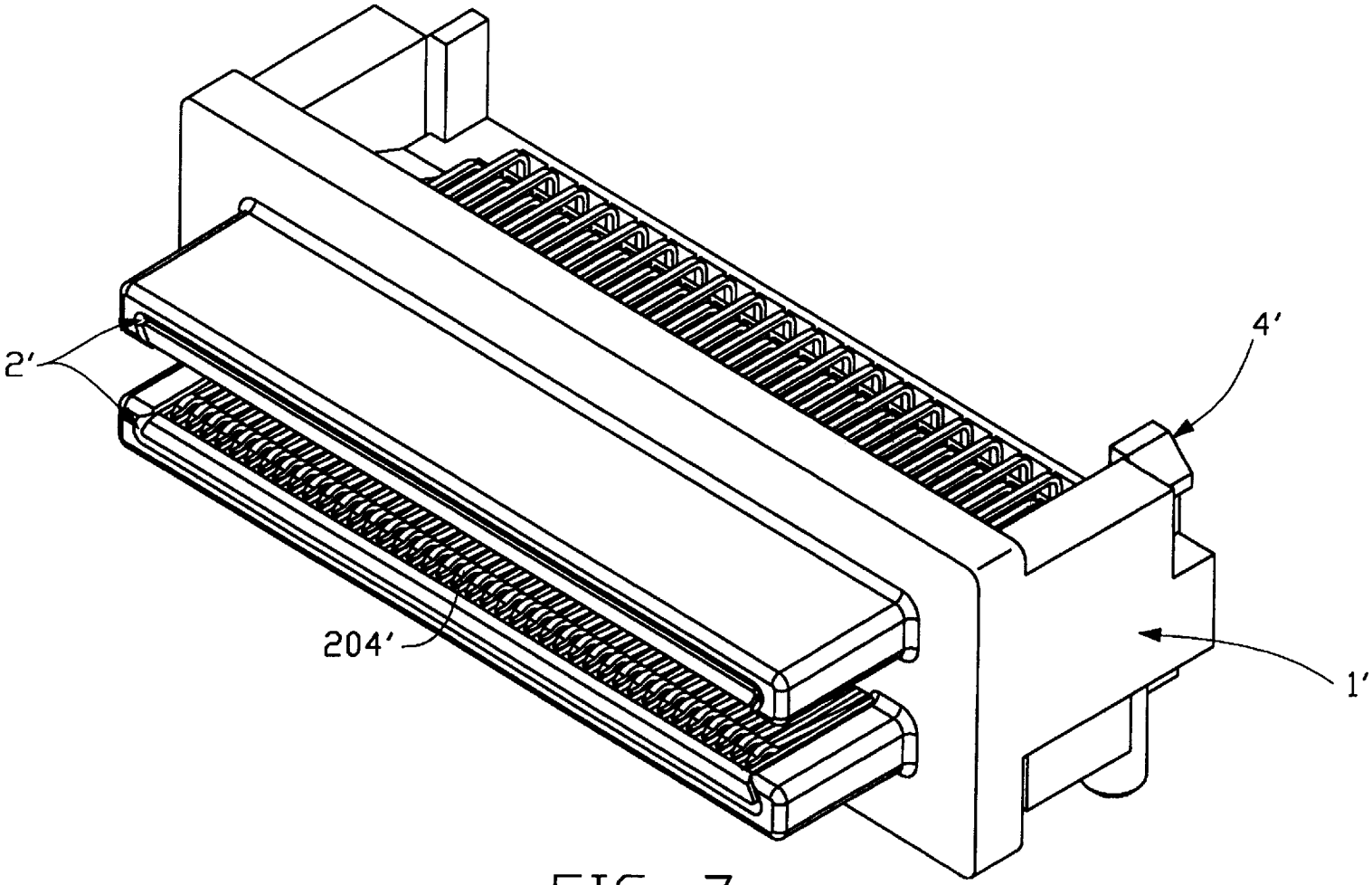
FIG. 7 is a perspective assembled view of the receptacle-type connector assembly.

Further referring to FIGS. 5, 6 and 7, a receptacle-type connector assembly comprises a dielectric housing 1', two receiving boards 2', a contact module comprising a contact base 20*a*' and a plurality of contacts 2*a*' comprising a mating end 204' and a joining end 202', and a spacer 4'. The housing 1' comprises a mating section 12', a flange 15' and a pair of joining sections 14'The mating section 12' consists of upper and lower portions defining a receiving chamber therebetween. Each portion comprises a guiding surface 13' and a pair of guiding grooves 10' defined in opposite ends of each guiding surface 13'Each joining section 14' has the same configuration as the first joining section 110 of the housing 1 of the plug connector and forms a pair of projecting side walls 112' and a pair of posts 113' thereon. The receiving chamber 120' is defined between the upper and lower portions of the mating section 12', and communicates with the guiding grooves 10'. A stop bar 102' and a stop barb 108' are formed on a spacing board 109' corresponding to the stop bar 106 and the stop barb 107 of the housing 1 of the plug-type connector assembly. Each receiving board 2' defines a plurality of engaging slots 24' for receiving the corresponding contacts 2*a*' on a main surface and forms a stop rib 21' along an edge opposite the engaging slots 24'.

The contact base 20*a*' is insert molded around middle portions of the contacts 2*a*' thereby forming the contact module. A latching aperture 308' is defined in an upper edge of the contact base 20*a*' for engaging with the stop barb 108' of the housing 1'. During assembly, the contacts 2*a*' of the contact module are received in corresponding engaging slots 24' of the receiving board 2' thereby forming a half-finished subassembly, i.e., contact assembly. The half-finished subassembly is then inserted into the mating section 12' and is guided by the guiding surfaces 13' and the guiding grooves 10' of the housing 1'. The stop rib 21' abuts against the stop bar 102' for preventing over-insertion of the mating receptacle, and the stop barb 108' engages with the latching aperture 308' for preventing the receiving board 2' from being driven out by the mating plug connector when the mating plug-type connector assembly is inserted into the housing 1'.

The spacer 4' is identical to the spacer 4 of the plug-type connector assembly. The spacer 4' forms a pair of latches 412' and openings 413' corresponding to the latches 412 and the openings 413*a* of the housing 1 of the plug-type connector assembly, and defines a plurality of receiving slots therein. The spacer 4' is attached to the housing 1' by the same means that the spacer 4 is attached to the housing 1 of the plug-type connector assembly thereby achieving a finished receptacle.

When the receptacle-type connector assembly is assembled with the plug-type connector assembly, the mating section 12' of the receptacle connector enters into the corresponding receiving chambers 103 of the plug-type connector assembly thereby achieving electrical connection between the receptacle and plug connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical plug connector comprising:

a dielectric housing comprising a mating section and a pair of joining sections; the mating section defining a receiving chamber therein, the joining sections extending from opposite sides of the mating section, a post extending downwardly from each of the joining sections;

a contact module comprising a dielectric contact base and a plurality of contacts each comprising a mating end and a joining end, the dielectric contact base having two horizontal plates for receiving the mating sections of corresponding contacts therein and being received in the receiving chamber of the dielectric housing; and a spacer being fixed to the housing and defining a plurality of receiving slots for receiving the joining ends of corresponding contacts therein, the spacer joining with the posts of the housing.

2. The electrical plug connector as claimed in claim 1, wherein a spacing board divides the receiving chamber of the housing into an upper and a lower channel for receiving corresponding horizontal plates of the contact module, respectively; a pair of stop boards being formed at opposite ends of the upper and lower channels along the inner face of each joining section to define a pair of guiding grooves between each stop board and the spacing board for guiding the horizontal plates of the contact module to enter into corresponding channels.

3. The electrical plug connector as claimed in claim 2, wherein each horizontal plate of the dielectric contact base has a pair of guiding sections at opposite sides thereof, each guiding section having a thickness the same as a width of corresponding guiding groove for guiding insertion into the corresponding upper and lower channels along the guiding grooves.

4. The electrical plug connector as claimed in claim 3, wherein a first bar is inwardly formed on a top surface of the upper channel and a second bar is inwardly formed on a bottom surface of the lower channel for positioning the contact module in the upper and lower channels, the first and second bars each forming a stop barb on a middle portion thereof for securing corresponding horizontal plate of the contact module.

5. The electrical plug connector as claimed in claim 4, wherein the contact base comprises a pair of vertical side walls, each vertical side wall of the contact base defining a latching aperture in a side surface of a top end opposite the horizontal plate for engaging with corresponding stop barb.

6. The electrical plug connector as claimed in claim 1, wherein the spacer comprises upper and lower steps, each step defining a plurality of receiving slots for receiving the joining ends of corresponding contacts.

7. The electrical plug connector as claimed in claim 6, wherein the lower step forms a pair of stop side walls at opposite sides for abutting against a rear surface of the mating section, and a pair of projecting sections at opposite bottom sides forms a semi-circular opening on an outer side thereof.

8. The electrical plug connector as claimed in claim 6, wherein the spacer includes a latch for abutting against a corresponding side wall of the housing, and wherein the latch defines a partial-circular opening on a lower portion thereof for cooperating with the semi-circular opening of the lower step thereby defining an opening for receiving corresponding post of the housing.

9. An electrical receptacle connector comprising:

a dielectric housing comprising a mating section and a pair of joining sections, the mating section defining a receiving chamber therein, the joining section extending from opposite ends of the mating section;

a plurality of contacts each comprising a mating end and a joining end, a middle portion between the mating end and the joining end;

said at least two receiving boards received in the receiving chamber in the mating section and defining a plurality of engaging slots therein for receiving the mating ends of corresponding contacts;

at least two dielectric contact bases insert molded around the middle portions of the contacts and received in the receiving chamber; and a spacer defining a plurality of receiving slots therein and fixed to the housing; wherein the mating section of the dielectric housing consists of upper and lower portions, each portion comprising a guiding surface and a guiding groove defined on opposite sides of corresponding guiding surface for guiding corresponding receiving board to be inserted into the mating section of the dielectric housing.

10. The electrical receptacle connector as claimed in claim 9, wherein the receiving board forms a stop rib on an edge opposite the engaging slots for abutting against corresponding stop bars of the housing.

11. The electrical receptacle connector as claimed in claim 10, wherein a pair of posts each downwardly extend from the joining sections of the dielectric housing for joining with the spacer.

12. The electrical receptacle connector as claimed in claim 9, wherein the spacer comprises upper and lower steps, each step defining a plurality of receiving slots for receiving the joining ends of corresponding contacts.

13. The electrical receptacle connector as claimed in claim 12, wherein the lower step forms a pair of stop side walls at opposite sides for abutting against a rear surface of the mating section, and a pair of projecting sections at opposite bottom sides forms a semi-circular opening on an outer side thereof.

14. The electrical receptacle connector as claimed in claim 13, wherein a pair of latches are formed on opposite sides of the upper step for abutting against projecting side walls of the dielectric housing, each side wall rearwardly extending from each joining section, and each latch defining a partial-circular opening on a lower portion thereof for cooperating with the semi-circular opening of the lower step thereby defining an opening for receiving corresponding post of the housing.

15. An electrical connector assembly comprising:

an electrical plug comprising a dielectric housing having a receiving chamber, a contact module consisting of a dielectric contact base insert molded around portions of a plurality of contacts and a spacer for positioning the contacts; and an electrical receptacle comprising a dielectric housing having a receiving chamber, at least two receiving boards received in the receiving chamber and having engaging slots therein, at least two contact bases insert molded around portions of a plurality of contacts and a spacer, the housing comprising a mating section forming an upper portion separate from and parallel to a lower portion, a pair of guiding grooves being defined in opposite ends of two respective surfaces of the upper and lower portions, respectively, for guiding the insertion of the guiding boards into the mating section.

16. An electrical plug-type connector assembly comprising:

a dielectric housing including a mating section adapted to engage with another mating section of a complementary receptacle-type connector, said mating section defining a receiving chamber and extending forward from a flange, said chamber being divided into a plurality of channels; and a plurality of contact modules respectively installed into the corresponding channels, each of said contact modules including a dielectric contact base with a plurality of contacts thereon; wherein a space remains in each of the channels after the corresponding contact module is installed thereinto so as to be able to receive therein a portion of said another mating section of the complementary receptacle-type connector, which is mechanically and electrically engaged to the corresponding contact module positioned in a same channel.

17. An electrical connector assembly comprising:

a plug type connector including:

a first dielectric housing including a first mating section, said first mating section defining a receiving chamber and extending forward from a flange, said chamber being divided into a plurality of channels; and a plurality of contact modules respectively installed into the corresponding channels, each of said contact modules including a first dielectric contact base with a plurality of first contacts therein; wherein a space remains in each of the channels after the corresponding contact module is installed thereinto;

a receptacle type connector assembly including:

a second dielectric housing including a second mating section which is engaged with the first mating section when the plug type connector and the receptacle type connector is mated with each other, said second mating section defining a plurality of guiding surfaces, each of said guiding surfaces defining a guiding groove; and a plurality of contact assemblies securely received within the corresponding guiding grooves, respectively, each of said contact assemblies including a second dielectric contact base with a plurality of second contacts therein; wherein each of the guiding surfaces with the associated corresponding contact assembly is adapted to be received within the space of the corresponding channel and is engaged with the corresponding contact module.

* * * * *